United States Patent [19]

Szabo

[11] Patent Number: 5,064,198

[45] Date of Patent: Nov. 12, 1991

[54] PUTTING AID FOR GOLFERS

[76] Inventor: Gerald S. Szabo, 806 Broadfield Dr., Newark, Del. 19713

[21] Appl. No.: 535,543

[22] Filed: Jun. 8, 1990

[51] Int. Cl.[5] ..... A63B 69/36

[52] U.S. Cl. ..... 273/189 R; 273/183 B

[58] Field of Search ..... 273/189 R, 166, 183 B, 273/188 R, 189 A, 54 B; 2/161 A

[56] References Cited

U.S. PATENT DOCUMENTS

| | | | |
|---|---|---|---|
| 1,681,389 | 8/1928 | Blake | 273/166 |
| 1,728,679 | 9/1929 | Hansard | 273/189 R |
| 2,083,604 | 6/1937 | Hay | 273/166 X |
| 2,496,808 | 2/1950 | Moore | 273/166 |
| 3,178,724 | 4/1965 | Perschke | 273/166 X |
| 3,606,343 | 9/1971 | Lemon | 273/189 R |

*Primary Examiner*—George J. Marlo

[57] ABSTRACT

A device for use by a golfer during a putting stroke. When putting, the strap is used by placing the adjustable wristband on the wrist of the trailing hand of the putting stroke. The finger strap is wrapped around the middle finger of the same hand with the wrist comfortably flexed to allow for the holding of the putter shaft. This fixed position will also freeze the movement of the other wrist and force the player to putt with a pendulum-like motion of the hand, arms and shoulders.

1 Claim, 2 Drawing Sheets

PUTTING AID FOR GOLFERS

BACKGROUND OF INVENTION

One of the most common mistakes in the game of golf while putting, is to break the wrist during the forward swing of the putter head to try to guide the ball toward the hole or to add extra distance on long putts. Using the correct putting stroke, the hands are held firm in a variety of grips, while the direction is determined by body alignment and power for the distance desired is determined by arm swing. In the prototypical perfect putt, a triangle is formed between the three points of the hands and both shoulders. This triangle moves as a unit with all starting angles remaining basically constant. Wearing the Champion Perfect Putting Strap, the finger strap which is worn on the trailing hand is wrapped as illustrated in FIG. 1, around the middle finger of that hand and attached to a velcro fastener on the wristband to lock the wrist in a slightly flexed position. Having the trailing wrist locked, the leading wrist which is holding the same shaft, will not easily break during the putting stroke. The Champion Perfect Putting Strap serves as both a physical and mental reminder of how the swing should be maintained during the putting effort. When putting is completed, the strap is repositioned around the wristband to allow for normal golf strokes.

Briefly, the present invention is conceived as a device which is comprised of an adjustable fabric strap connected to an adjustable fabric wristband. The adjustability of both wristband and the strap allow for different hand sizes and flexed wrist positions. Without major adjustments, the Champion Perfect Putting Strap can be used by individuals of various sizes.

DETAILED DESCRIPTION OF DRAWINGS

Figure 1:
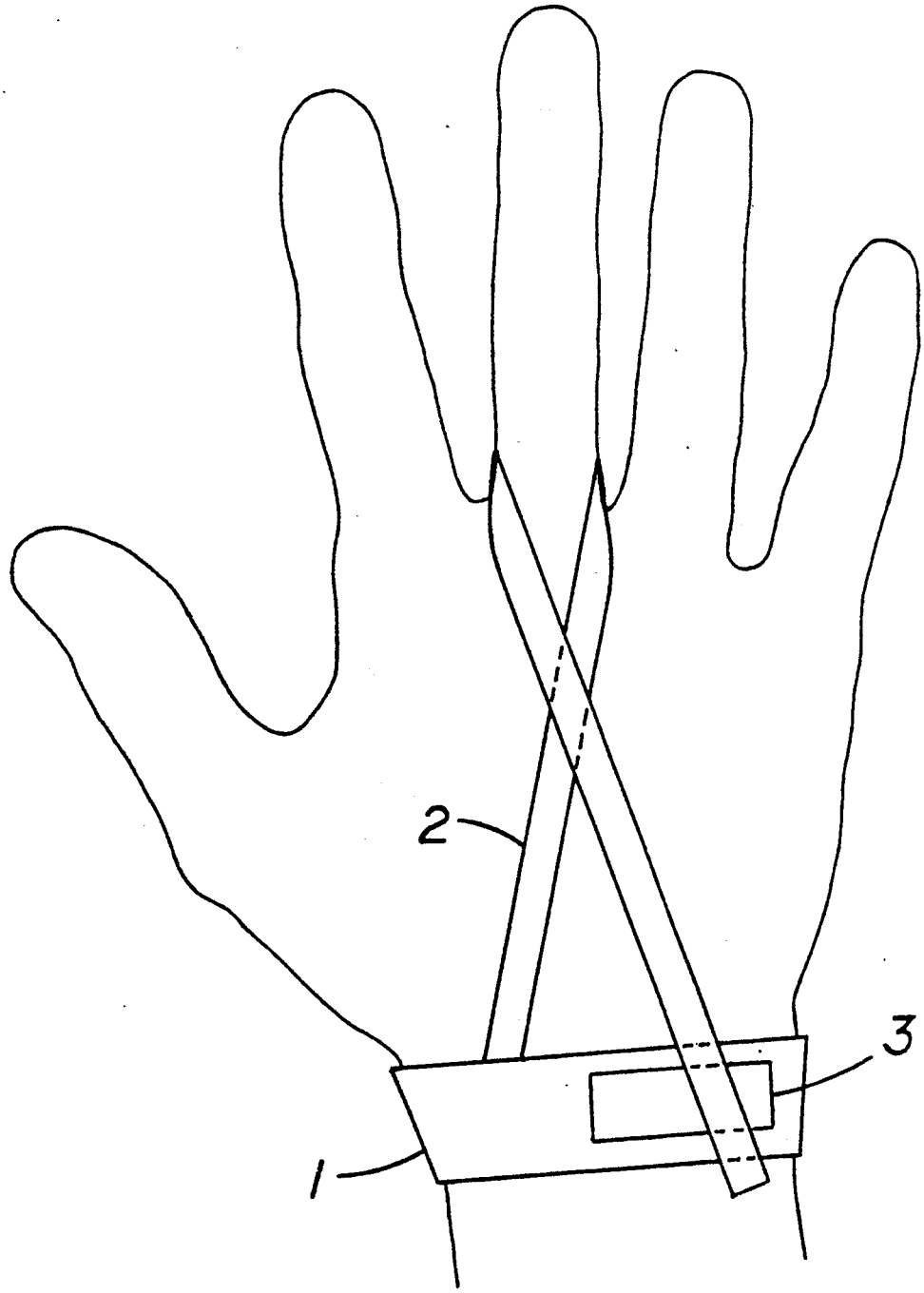
FIG. 1. Perspective view of wristband and strap.

FIG. 1 illustrates the putting strap of this invention attached to the back of the trailing hand. The wristband 1 is attached to the palm side of the wrist by a Velcro-type fastener. The finger strap 2 is then wrapped in a counter clock-wise direction around the middle finger and then attached to a Velcro-like pad 3.

Figure 2:
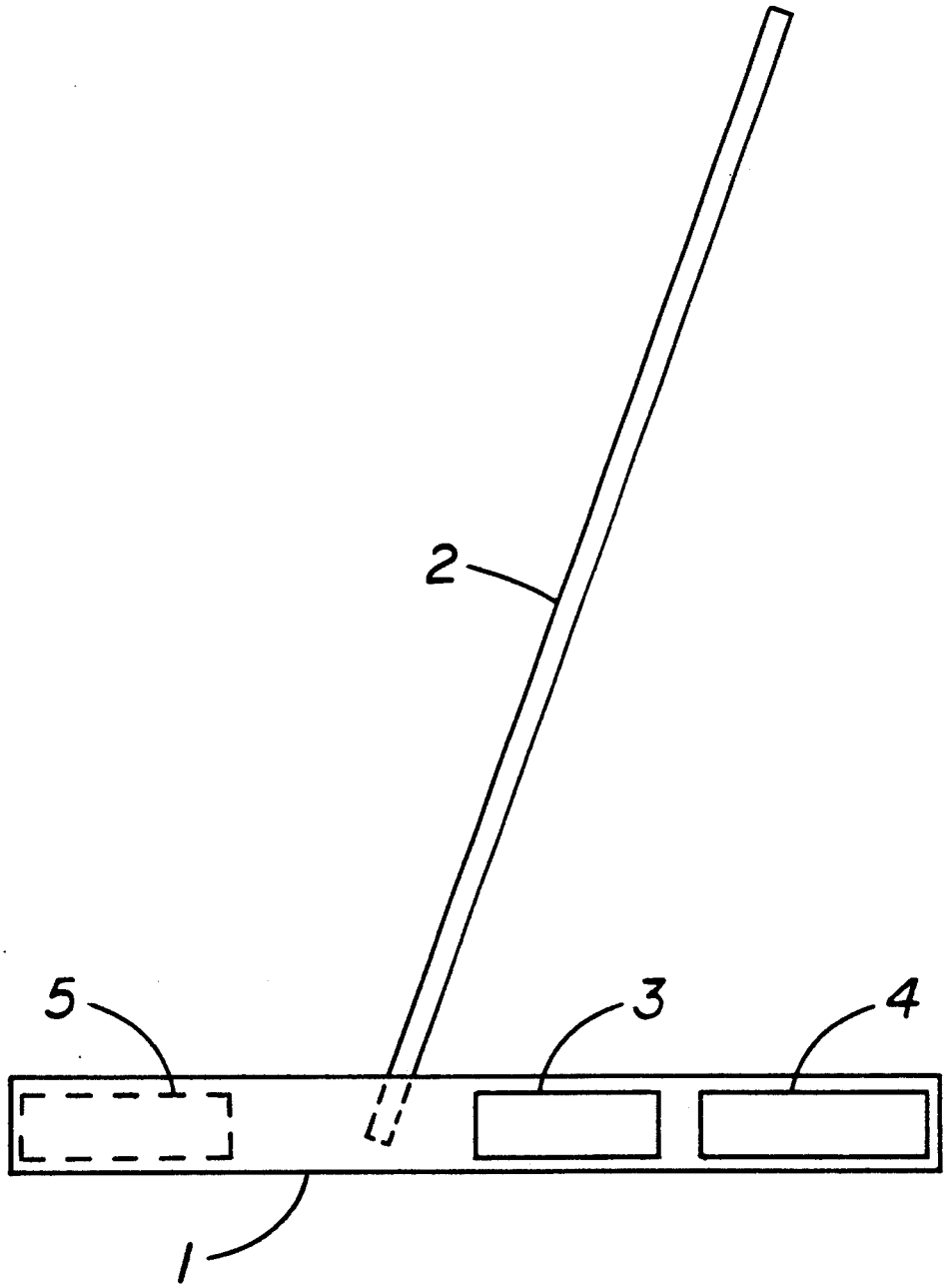
FIG. 2. Developed view of the strap.

FIG. 2 shows the putting strap as it would look in the flat position. Member 4 and 5 comprise the Velcro-like fastener used for the attaching of the putting strap to the wrist. Once this wrist attachment is accomplished to size then the finger strap 2 is as previously stated wrapped in a counter-clockwise direction around the middle finger in such a manner to decrease the distance from the knuckle of the small finger to the proximal point of origin of the wrist at the ulnar styloid process, with a tension set by user which allows for the comfortable grasping of a putter.

I claim:

1. A device for use by a golfer while putting a golf ball consisting of an elongated wrist band having opposite ends for encircling a golfer's wrist, means at the opposite ends of said wrist band for adjustably securing said wrist band to the wrist of the golfer's trailing hand during a putting stroke, an elongated finger strap having a first attached end and a second free end, said first end of said finger strap being attached to said wrist band, the length of said finger strap being such that with said wrist band attached to the wrist of the golfer's trailing hand during a putting stroke, said strap may be extended from the back side of the golfer's wrist toward, and counter-clockwise around the middle finger of the golfer's trailing hand, and back to a predetermined location on said wrist band, said location being adjacent said first attached end of said finger strap and spaced a slight distance therefrom in a clockwise direction, means at said predetermined location and at the second free end of said finger strap for adjustably securing said second free end to said wrist band, whereby the wrist of the golfer's trailing hand may be locked in a slightly flexed position and will not easily break during the putting stroke.

* * * * *